US010314459B2

(12) United States Patent
Dirisala et al.

(10) Patent No.: US 10,314,459 B2
(45) Date of Patent: Jun. 11, 2019

(54) DISHWASHER WITH SOUND ATTENUATION TOE KICK PANEL

(71) Applicant: WHIRLPOOL CORPORATION, Benton Harbor, MI (US)

(72) Inventors: Venkata S. Dirisala, Benton Harbor, MI (US); Aaron P. Bennett, Saint Joseph, MI (US); Amirkhan A. Modi, Aundh (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/363,565

(22) Filed: Nov. 29, 2016

(65) Prior Publication Data

US 2017/0258291 A1 Sep. 14, 2017

Related U.S. Application Data

(63) Continuation-in-part of application No. 15/065,232, filed on Mar. 9, 2016, now Pat. No. 10,098,520.

(51) Int. Cl.
*A47L 15/42* (2006.01)
*A47L 15/48* (2006.01)

(52) U.S. Cl.
CPC ..... *A47L 15/4209* (2016.11); *A47L 15/4265* (2013.01); *A47L 15/483* (2013.01); *A47L 15/488* (2013.01)

(58) Field of Classification Search
CPC ..... A47L 15/4209
See application file for complete search history.

(56) References Cited

U.S. PATENT DOCUMENTS

| | | | | |
|---|---|---|---|---|
| 5,524,358 | A | 6/1996 | Matz | |
| 7,594,513 | B2 | 9/2009 | VanderRoest et al. | |
| 8,696,824 | B2 | 4/2014 | Jadhav et al. | |
| 8,758,525 | B2 | 6/2014 | Kim | |
| 2002/0134615 | A1* | 9/2002 | Herreman | A47B 77/022 181/290 |
| 2005/0076938 | A1* | 4/2005 | Jordan | A47L 15/4263 134/183 |
| 2006/0090778 | A1* | 5/2006 | Oakes | A47L 15/4257 134/56 D |
| 2008/0236638 | A1* | 10/2008 | Bragg | F04D 17/122 134/184 |

FOREIGN PATENT DOCUMENTS

DE 102012203321 A1 9/2013

* cited by examiner

*Primary Examiner* — Jason Y Ko
(74) *Attorney, Agent, or Firm* — McGarry Bair PC

(57) ABSTRACT

A dishwasher can comprise a tub to define a treating chamber in which articles are treated according to a cycle of operation. The treating chamber can have an access opening with a cover selectively permitting access to the treating chamber. A condenser assembly can fluidly couple to the treating chamber for drying articles washed during the cycler of operation. The condenser can fluidly couple to an exhaust conduit disposed in a toe kick panel, which attenuates the sound travelling through the toe kick panel.

20 Claims, 11 Drawing Sheets

DISHWASHER WITH SOUND ATTENUATION TOE KICK PANEL

CROSS-REFERENCE TO RELATED APPLICATION(S)

This application claims priority to and is a continuation-in-part of U.S. patent application Ser. No. 15/065,232, filed Mar. 9, 2016, now U.S. Pat. No. 10,098,520, which is incorporated herein by reference in its entirety.

BACKGROUND OF THE INVENTION

Automatic dishwashers for use in a typical household include a tub defining a treating chamber and a spraying system for recirculating liquid throughout the tub to remove soils from the dishes and utensils. Two common configurations are a door-type, where a pivoting door provides access to a treating chamber where dishes are washed or a drawer-type where a drawer provides access to the as well as defining a major portion of the treating chamber. In either configuration, a rack for holding dishes to be cleaned is typically provided within the treating chamber.

BRIEF DESCRIPTION OF THE INVENTION

In one aspect, the disclosure relates to a dish treating appliance for treating dishes according to an automatic cycle of operation. The dish treating appliance includes a tub at least partially defining a treating chamber and having an access opening to the treating chamber. A cover selectively opens and closes the access opening. A condenser assembly includes an inlet and an outlet, with the inlet fluidly coupled to the tub. A toe kick panel includes an exhaust conduit fluidly coupled to the outlet of the condenser assembly. The toe kick panel further includes at least one noise attenuation structure disposed in the exhaust conduit.

In another aspect, the disclosure relates to a toe kick panel for an appliance having a treating chamber and a condenser fluidly coupled to the treating chamber for treating an article according to an automatic cycle of operation. The toe kick panel includes a frame defining an interior and having an inlet and an outlet. An exhaust conduit extends between the inlet and the outlet, and fluidly couples the condenser at the inlet. At least one noise attenuation structure is provided in the exhaust conduit.

DESCRIPTION OF EMBODIMENTS OF THE INVENTION

Automatic dishwashers can include a drying cycle which can include heating the treating chamber to evaporate a part of liquid used to wash or rinse the dishes and can include a condenser to further remove humidity from the humid air within the treating chamber. Typical condensers highly depend on the temperature difference between the humid air and the condenser walls. A reduction in this temperature difference reduces condenser efficiency. Often, the walls are thin, requiring minimal cooling to maintain the temperature difference. Condenser walls permit noise to escape from the condenser and the treating chamber, generating noise pollution into a consumer's kitchen or home. In order to combat the noise, sound blankets and other insulation are used to attenuate the noise pollution created by the dishwasher but these add cost and assembly time to the dishwasher.

Figure 1:
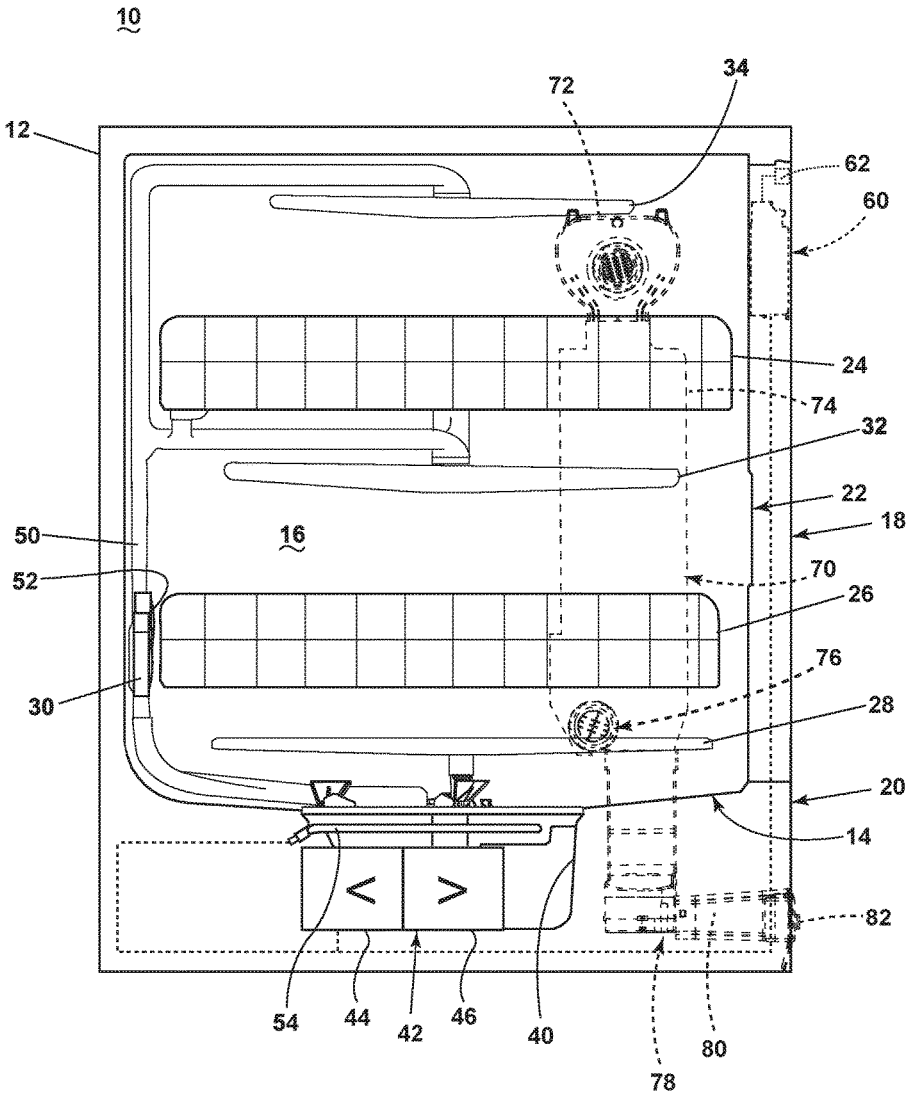
FIG. 1 is a schematic, cross-sectional view of a dishwasher with a condenser.

In FIG. 1, an automated dishwasher 10 includes a chassis 12 to define an interior of the dishwasher 10 and can include a frame, with or without panels mounted to the frame. A tub 14 can be provided within the chassis 12 and can at least partially define a treating chamber 16, having an open face, for washing dishes. A closure such as a cover or a door assembly 18 can be movably mounted to the dishwasher 10 for movement between opened and closed positions to define an access opening 22, the door assembly 18 selectively opening and closing the access opening 22. Thus, the door assembly 18 provides accessibility to the treating chamber 16 through the access opening 22 for the loading and unloading of dishes or other washable items. It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

The chassis 12 can further comprise a bottom panel 20 disposed beneath the pivot point of the door assembly 18. The door assembly 18 is shown in an exemplary closed position, but can be selectably opened to provide access to the treating chamber through an access opening 22.

Dish holders, illustrated in the form of upper and lower dish racks 24, 26, are located within the treating chamber 16 and receive dishes for washing. The upper and lower racks 24, 26 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system is provided for spraying liquid in the treating chamber 16 and is provided in the form of a first lower spray assembly 28, a second lower spray assembly 30, a rotating mid-level spray arm assembly 32, and/or an upper spray arm assembly 34. Upper sprayer 34, mid-level rotatable sprayer assembly 32 and lower rotatable sprayer assembly 28 are located, respectively, above the upper rack 24, beneath the upper rack 24, and beneath the lower rack 26 and are illustrated as rotating spray arms. The second lower spray assembly 30 is illustrated as being located adjacent the lower dish rack 26 toward the rear of the treating chamber 16. The second lower spray assembly 30 is illustrated as including a vertically oriented distribution header or spray manifold 52. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 40 and a pump assembly 42. The sump 40 collects the liquid sprayed in the treating chamber 16 and can be formed by a sloped or recessed portion of a bottom wall of the tub 14. The pump assembly 42 can include both a drain pump 44 and a recirculation pump 46. The drain pump 44 can draw liquid from the sump 40 and pump the liquid out of the dishwasher 10 to a household drain line (not shown). The recirculation pump 46 can draw liquid from the sump 40 and the liquid can be simultaneously or selectively pumped through a supply tube 50 to each of the assemblies 24, 26, 28, 30 for selective spraying. While not shown, a liquid supply system can include a water supply conduit coupled with a household water supply for supplying water to the treating chamber 16. A heating system including a heater 54 can be located within the sump 40 for heating the liquid contained in the sump 40 or heating the dishwasher during a drying cycle, for example.

A controller 60 can also be included in the dishwasher 10, which can be operably coupled with various components of the dishwasher 10 to implement a cycle of operation. The controller 60 can be located within the door 18 as illustrated, or it can alternatively be located somewhere within the chassis 12. The controller 60 can also be operably coupled with a control panel or user interface 62 for receiving user-selected inputs and communicating information to the user. The user interface 62 can include operational controls such as dials, lights, switches, and displays enabling a user to input commands, such as a cycle of operation, to the controller 60 and receive information.

A condenser 70 can be provided between the chassis 12 and the tub 14, extending along a side portion of the tub 14. The condenser 70 can mount to the chassis 12 or the tub 14, such as by fastening with fasteners or by welding. An inlet section 72 can provide fluid communication between the treating chamber 16 and the condenser 70 near the top of the treating chamber 16. The inlet section 72 feeds air from the treating chamber 16 to the condensing section 74. The condensing section 74 can comprise an integrated water inlet 76, such that water and condensed liquid can be supplied to the treating chamber 16 from the water inlet 76. An outlet section 78 fluidly couples to the condensing section 74 opposite of the inlet section 72. The outlet section 78 comprises an outlet conduit 80 and an exhaust outlet 82 for exhausting the condensed airflow to the ambient. The outlet section 78 can be formed from multi-layer material or a molded polyester to improve sound attenuation.

Figure 2:
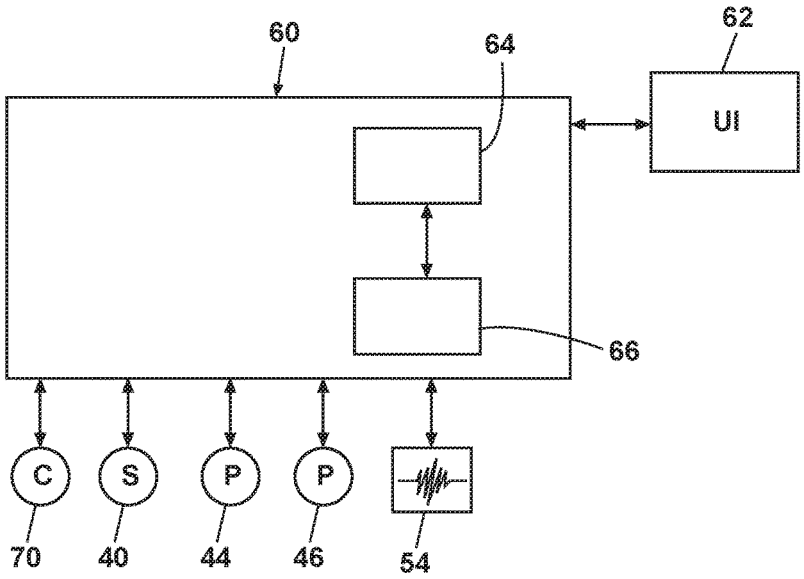
FIG. 2 is a schematic view of a controller of the dishwasher of FIG. 1.

As illustrated schematically in FIG. 2, the controller 60 can be coupled with the heater 54 for heating the wash liquid during a cycle of operation, the drain pump 44 for draining liquid from the treating chamber 16, and the recirculation pump 46 for recirculating the wash liquid during the cycle of operation. Additionally, the controller 60 can be coupled to the condenser 70 for selectively operating the condenser 70 during the cycle of operation, such as a drying cycle. The controller 60 can be provided with a memory 64 and a central processing unit (CPU) 66. The memory 64 can be used for storing control software that can be executed by the CPU 66 in completing a cycle of operation using the dishwasher 10 and any additional software. For example, the memory 64 can store one or more pre-programmed cycles of operation that can be selected by a user and completed by the dishwasher 10. The controller 60 can also receive input from one or more sensors (not shown). Non-limiting examples of sensors that can be communicably coupled with the controller 60 include a temperature sensor and turbidity sensor to determine the soil load associated with a selected grouping of dishes, such as the dishes associated with a particular area of the treating chamber.

Figure 3:
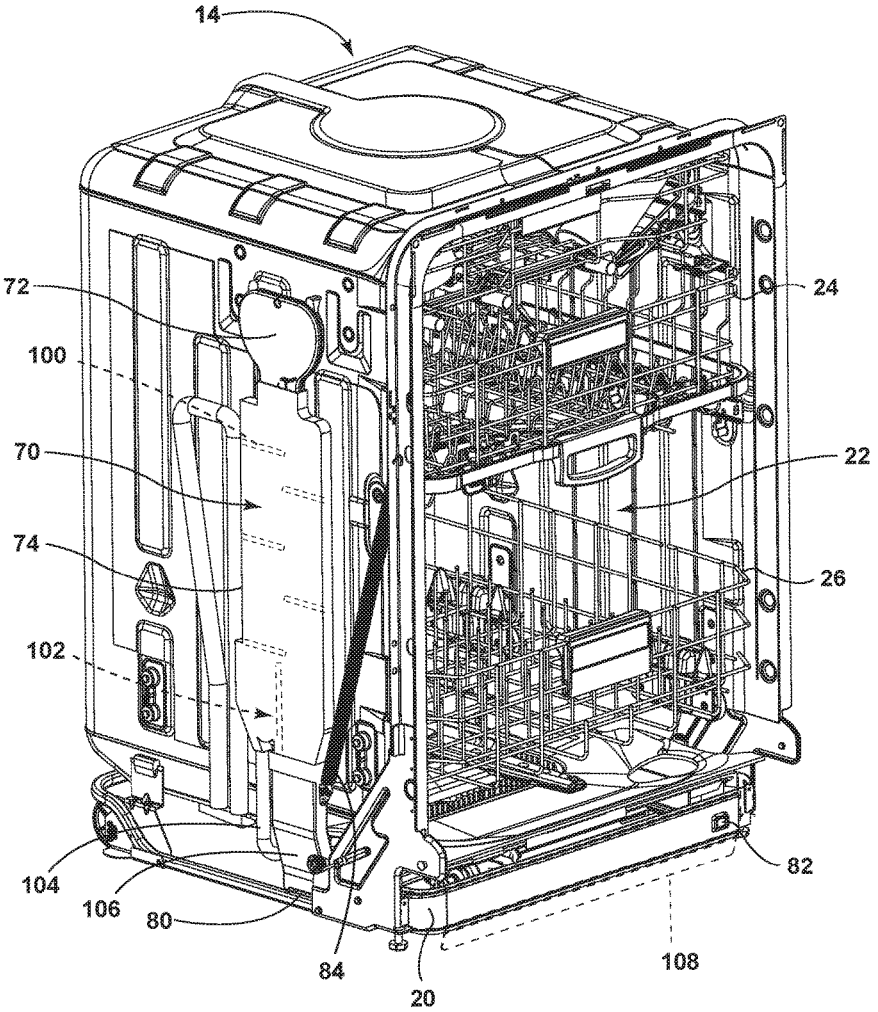
FIG. 3 is a top perspective view of the dishwasher of FIG. 1.

Turning to FIG. 3, the chassis 12 has been removed from the dishwasher 10 illustrating the outer sides of the tub 14. The condenser 70 includes a plurality of walls 100 disposed within the condensing section 74. The walls 100 extend from the sides of the condenser 70 partially across the condensing section 74 internally, defining a serpentine airflow path within the condensing section 74. The condensing section 74 further includes an inlet wall 102, separating the water inlet 76 (FIG. 1) from the rest of the condensing section 74. A supply of water can be fed to the condenser 70 from a water conduit 104, where the supply of water can be fed into the treating chamber 16 through the water inlet 76. The condenser 70 can mount to the tub 14 or, alternatively, the chassis 12 by a suspension 84, illustrated as an exemplary spring.

An intermediate conduit 106 fluidly couples the condenser conduit 74 to the outlet section 78. The outlet conduit 80 can run along the bottom of the dishwasher 10, behind the bottom panel 20, exhausting the condensed air through the exhaust outlet 82. Additionally, the bottom panel 20 can comprise a toe kick area 108, extending below the bottom panel 20. The toe kick area 108 can comprise, for example, a kick plate preventing a user from kicking the outlet section 78. The outlet conduit 80 can extend along the toe kick area 108 having the exhaust outlet 82 located opposite of the condensing section 74 relative to the dishwasher 10. The outlet conduit 80 can extend along part of or the entire toe kick area 108, defined by placement of the exhaust outlet 82.

Figure 4:
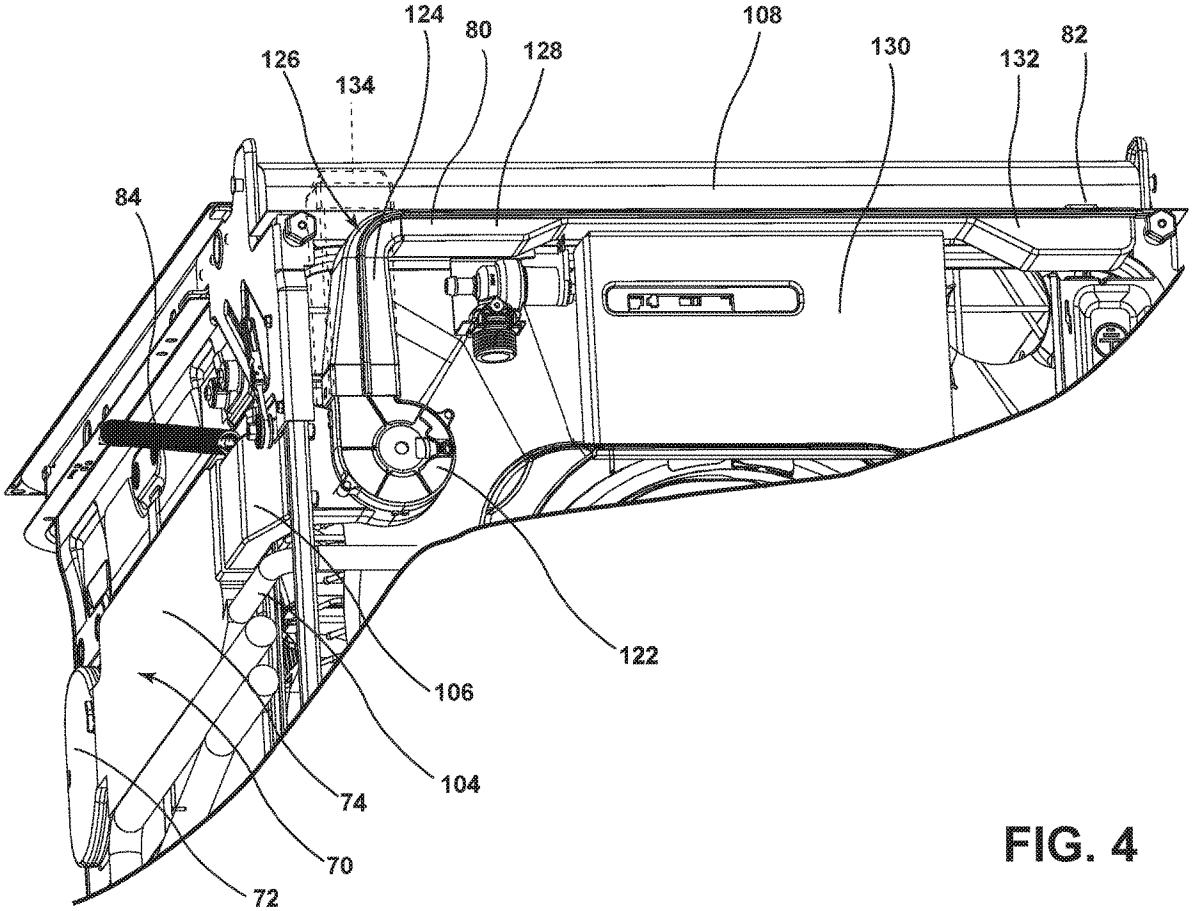
FIG. 4 is a bottom perspective view of the dishwasher of FIG. 3 illustrating an outlet section of the condenser showing a typical outlet in dashed line.

Turning now to FIG. 4, a bottom perspective view of the dishwasher 10 best illustrates the outlet section 78 of the condenser 70. The outlet section 78 couples to the condensing section 74 via the intermediate conduit 106, feeding a fan 122 of the condenser 70 the condensed air from the condensing section 74. The fan 122 can draw moist air from the treating chamber 16 through the inlet section 72 and into the condensing section 74 to condense the moist air.

The outlet conduit 80 can further comprise a forward conduit section 124, a ducting turn 126, a lateral conduit section 128, and an exhaust section 132. The fan 122 pushes the condensed air through a forward conduit section 124 of the outlet conduit 80. The forward conduit section 124 moves the condensed air toward the front of the dishwasher 10 where it turns at a ducting turn 126 and moves along the front of the dishwasher 10 along a lateral conduit section 128. The lateral conduit section 128 extends along at least a portion of the toe kick area 108. The lateral conduit section 128 fluidly couples to an exhaust section 132 where the condensed air exhausts through the exhaust outlet 82. The lateral conduit section 128 can mount to the bottom of the tub 14 or to a cover plate 130 for covering the controller.

A contemporary exhaust outlet 134 utilized in the prior art is shown in dashed line. The contemporary exhaust outlet 134 is located such that the fan 122 typically pushes the condensed air forward and immediately out of the condenser 70 and dishwasher 10. The noise associated with the fan 122 also travels out the typical exhaust outlet 134, generating a noise audible and recognizable by a user. Replacement of the contemporary exhaust outlet 134 with the illustrated and above described outlet section 78 greatly reduces the amount of noise emitted from the dishwasher 10.

The condenser 70, referred to hereinafter as a condenser assembly 70, can comprise one or more of the inlet section 72, the condensing section 74, the outlet section 78, the outlet conduit 80, the exhaust outlet 82, the intermediate conduit 106, the fan 122, the forward conduit 124, the turn 126, the lateral conduit section 128, and the exhaust section 132. Contemporary drying systems also utilize plastic, which does not contribute much for sound attenuation. The condenser assembly 70 described herein can be made of a multi-layer material or a molded polyester, both of which provide better sound attenuation.

Figure 5:
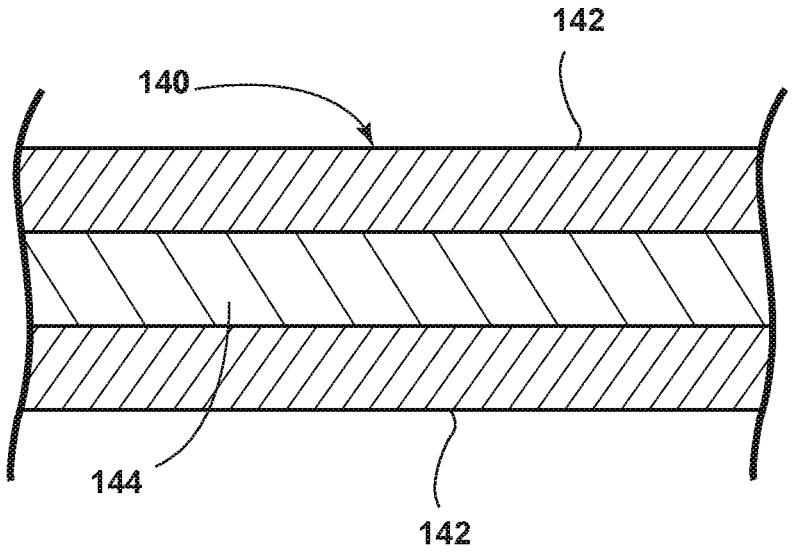
FIG. 5 is a schematic, cross-sectional view of the condenser walls showing a multi-layer material.

FIG. 5 illustrates a multi-layer absorptive acoustic material 140 that can be utilized in portions of the condenser assembly 70. Such a multi-layer material 140 attenuates the sound emanating from the treating chamber 16 and travelling through the condenser assembly 70 and out the outlet conduit 80, as well as sounds generated by the fan 122 and the pump assembly 42. The multi-layer material 140 can comprise multiple layers of molded polyester or other materials. The multi-layer material 140 can include, but is not limited to, two outer layers of polyester 142 with an inner layer of plastic 144 between the polyester layers 142 to form a composite acting as a moisture barrier. The total thickness of the multi-layer material 140 can be a minimum of 2.0 millimeters (mm) and a maximum of 25 mm. During a drying cycle, most of the noise generated by the dishwasher 10 is emanated as airborne noise. The multi-layer material 140 attenuates the airborne noise. Changing the noise frequency to a lower frequency to provide a more appealing sound quality. This reduces the dry noise sound of the dishwasher 10 and reduces the overall spectrum of the dry noise.

Figure 6:
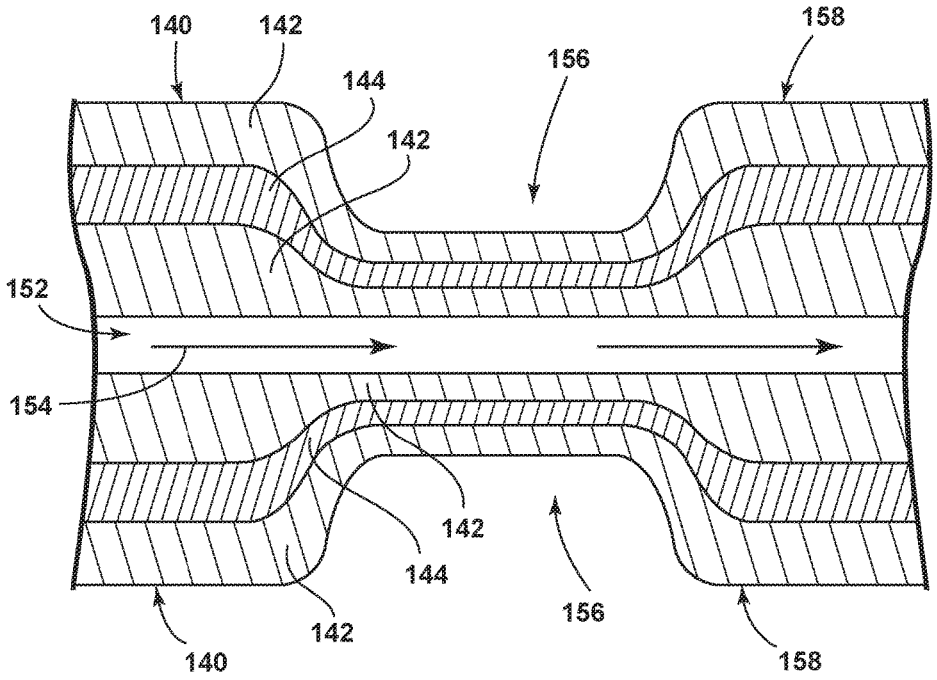
FIG. 6 is a schematic, cross-sectional view of the multi-layer material showing compressed and non-compressed sections.

Turning to FIG. 6, the multi-layer material 140 can further be compressed where required to accommodate for the condenser assembly 70, while remaining non-compressed where sound absorption is required. The multi-layer material 140 can have an interior flow conduit 152, which can be any conduit described herein, for directing a flow of air 154 through the condenser 70. A compressed portions 156 can be compressed to modify the condenser geometry by reducing the thickness of a portion of the condenser 70 providing additional dishwasher space where necessary. Non-compressed portions 158 can be utilized where sound attenuation is required, as the non-compressed portions 158 provide increased noise attenuation relative to the compressed portions 156.

It should be appreciated that the layered structure as illustrated in FIG. 5 is merely exemplary and that the multi-layer material 140 can comprise additional layering configurations, such as more or less layers, having additional or alternative materials between layers of polyester, etc. In one such example, the multi-layer material 140 can include a compressed four-layer material having two outer layers of polyester with two middle plastic layers. Additionally, polyester and plastic materials are exemplary and can be replaced with any suitable materials for attenuating noise within the condenser assembly 70.

Figure 7:
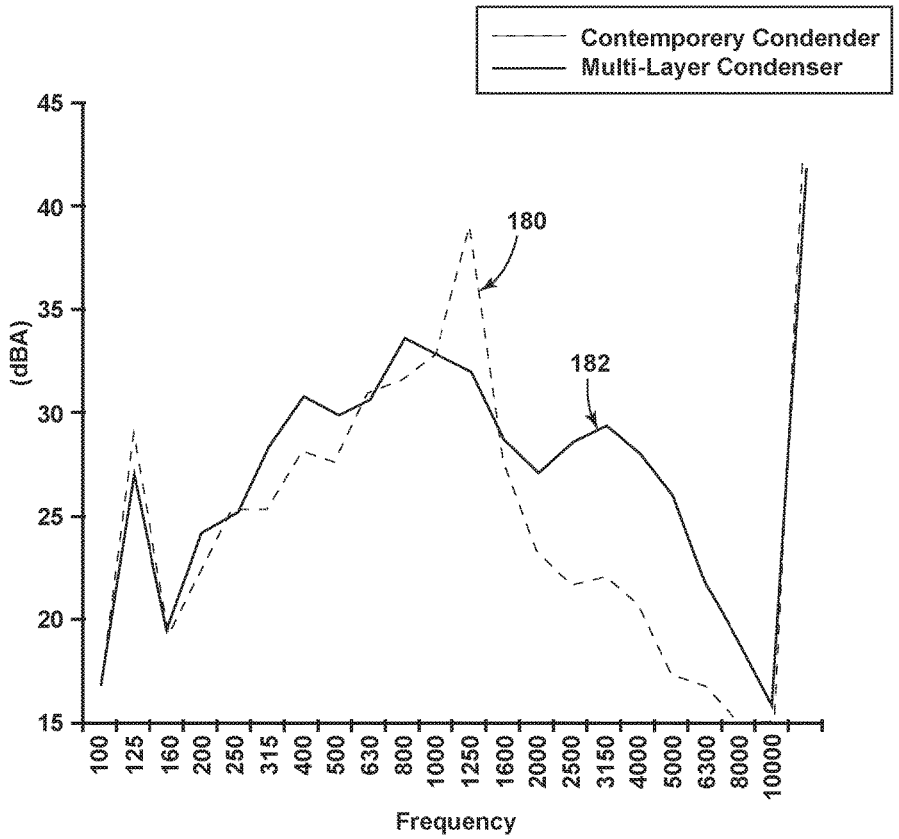
FIG. 7 is a plot illustrating exemplary decibel levels for the dishwasher of FIG. 1 and a contemporary dishwasher.

Looking at FIG. 7, a plot illustrates the decibel levels 180 for a similar dishwasher at different frequencies for a contemporary condenser and decibel levels 182 for the dishwasher 10 having a condenser assembly 70 utilizing the multi-layer material 140. The decibel levels 180 for the contemporary condenser include a maximum decibel (dBA) level of about 39 dBA at 1250 Hertz (Hz), while the decibel levels 182 for the condenser assembly 70 having the multi-layer material 140 has a maximum decibel level of about 34 dBA at a frequency of about 800 Hz. The multi-layer material 140 is beneficial in attenuating the noise, decreasing the overall decibel level of the condenser assembly 70, and shifting the frequency at which the highest decibel level occurs.

Furthermore, the multi-layer absorptive acoustic material 140 can attenuate the high frequency sound, as compared to a single layer of hard plastic material. Additionally, the multi-layer material 140 improves psychoacoustic metrics, such as time decay, loudness, and pleasantness, which helps to gain perception of improved drying sounds quality. The sound then emitted from the condensing section 72 is quieter, having less frequency content as compared to a single-layer plastic material. Overall sound quality emitted from the condenser assembly 78 is improved.

Figure 8:
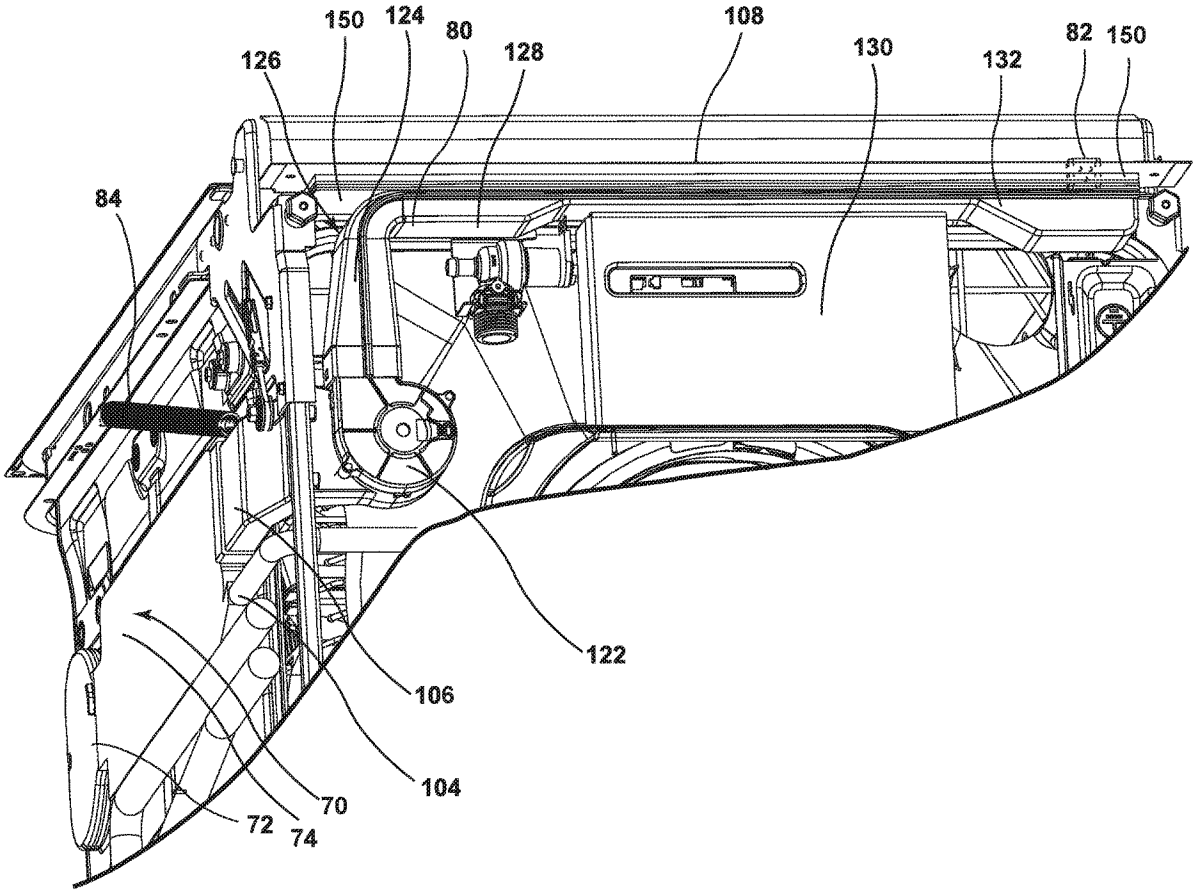
FIG. 8 is a bottom perspective view of the dishwasher of FIG. 3 having a toe kick area with insulation.

Turning now to FIG. 8, it can be appreciated that the toe kick area 108 can be moved forward, relative to the front of the dishwasher 10. The forward disposition of the toe kick area 108 provides room for inserting layered insulation 150, illustrated in dashed line, between the lateral conduit section 128 and the toe kick area 108. While it is contemplated that the multi-layer material 140 can eliminate the need for insulation, FIG. 8 contemplates utilizing additional insulation 150 between the condenser assembly 78 and the toe kick area 108. It will be understood that the insulation 150 can be a minimal amount and that the overall insulation requirement for the dishwasher 10 can still be reduced as compared to contemporary machines. Thus, insulation cost can be reduced and space within the dishwasher chassis 12 is increased with less utilized insulation 150.

It should be appreciated that the condenser assembly 70 in combination with the use of a multi-layer material 140 provides for attenuation of noise generated by the dishwasher 10. The reduced noise provides for quieter operation with less frequency content for a preferable consumer experience. Additionally, the reduced noise levels require minimal or no insulation for noise attenuation for the condenser assembly 70, increasing utilizable space within the dishwasher unit without increasing the overall noise of the dishwasher. Furthermore, the reduction of insulation reduces overall production cost for the unit. Routing the lateral conduit section 128 of the outlet conduit 80 and the condenser assembly 70 across the toe kick area 108 provides additional space for reducing the noise moving with the dry air. The increased space increases overall time in which air travels through the condenser assembly 70, providing for longer opportunity to attenuate the condenser noise. The multi-layer material 140, that can include materials such as polyester provides, for a reduction in overall decibel levels of the noise moving through the condenser unit as well as minimizes the frequency of the noise, providing a more appealing sound quality.

Figure 9:
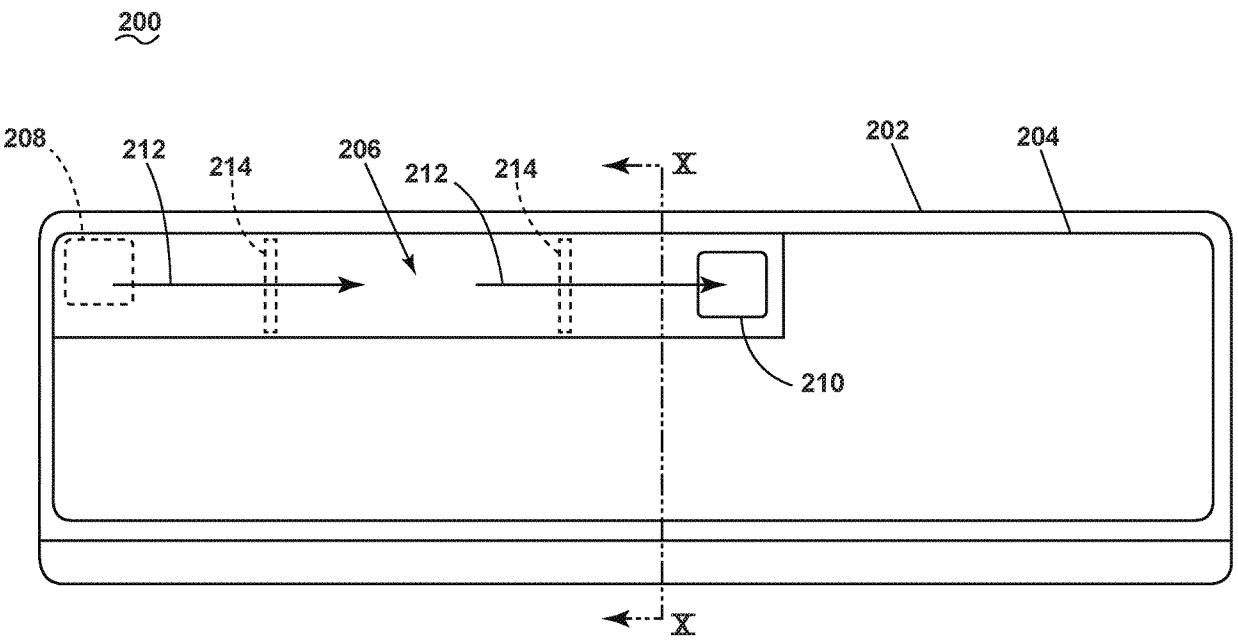
FIG. 9 is a front view of a toe kick plate including an exhaust conduit having noise attenuation structures.

Referring now to FIG. 9, a toe kick panel 200, which can be a toe kick panel provided at the toe kick area 108 of FIGS. 3-8, includes a frame 202. For example, the toe kick panel 200 can be the exterior bottom panel 20 (FIG. 1) covering the front of the dishwashing appliance at the base. Alternatively, the toe kick panel 200 can be a combination of the toe kick area 108 and the lateral conduit and exhaust sections 128, 132 for providing for exhausting of condensed air from the condenser 70. See FIG. 8, for example.

The frame 202 can be made of the multi-layer absorptive acoustic material, such as the multi-layer material 140 of FIG. 5, for example, or any multi-layer material as described herein. Such multi-layer material can be compressed, as described in FIG. 6. An insulator 204 can at least partially define an exhaust conduit 206 with the frame 202. The insulator 204 can be made of an insulative material, such as a polyester in one non-limiting example, and can be uncompressed as compared to the compressed material of the frame 202. Such an insulator 204 can provide dampening of striking forces, such as kick, to the toe kick panel 200. Simultaneously, the polyester can provide for noise attenuation at the toe kick panel 200. The exhaust conduit 206 can fluidly couple a condenser to the exterior of the appliance, can be any condenser described herein, such as the condenser 70 of FIG. 8.

An inlet 208 and an outlet 210 can define a flow passage 212 through the exhaust conduit 206. The inlet 208 can fluidly couple the exhaust conduit 206 to a condenser, such as the condenser 70 of FIG. 8, being coupled via the fan 122. The outlet 210 can exhaust to the ambient, such as at the front and bottom of the appliance. At least one noise attenuation structure 214 can be provided in the exhaust conduit 206, such that an airflow passing along the flow passage 212 passes through the noise attenuation structures 214. While illustrated as extending fully across the exhaust conduit 206, it should understood that the noise attenuation structures 214 can extend partially across the exhaust conduit 206. Additionally, while two noise attenuation structures 214 are illustrated, any number, including one or more noise attenuation structure 214 can be included.

The noise attenuation structure 214 can attenuate noise passing along the exhaust conduit 206 while permitting exhausting of condensed air from a condenser. The reduced noise provides for quieter operation with less frequency content for a preferable consumer experience, while providing for exhausting of the condensed air exterior of the appliance. Additionally, less noise insulation is required reducing costs. Finally, condensed air is exhausted to the ambient as opposed to in a confined area adjacent the appliance, where waterproofing would otherwise be required, further reducing costs.

Figure 10:
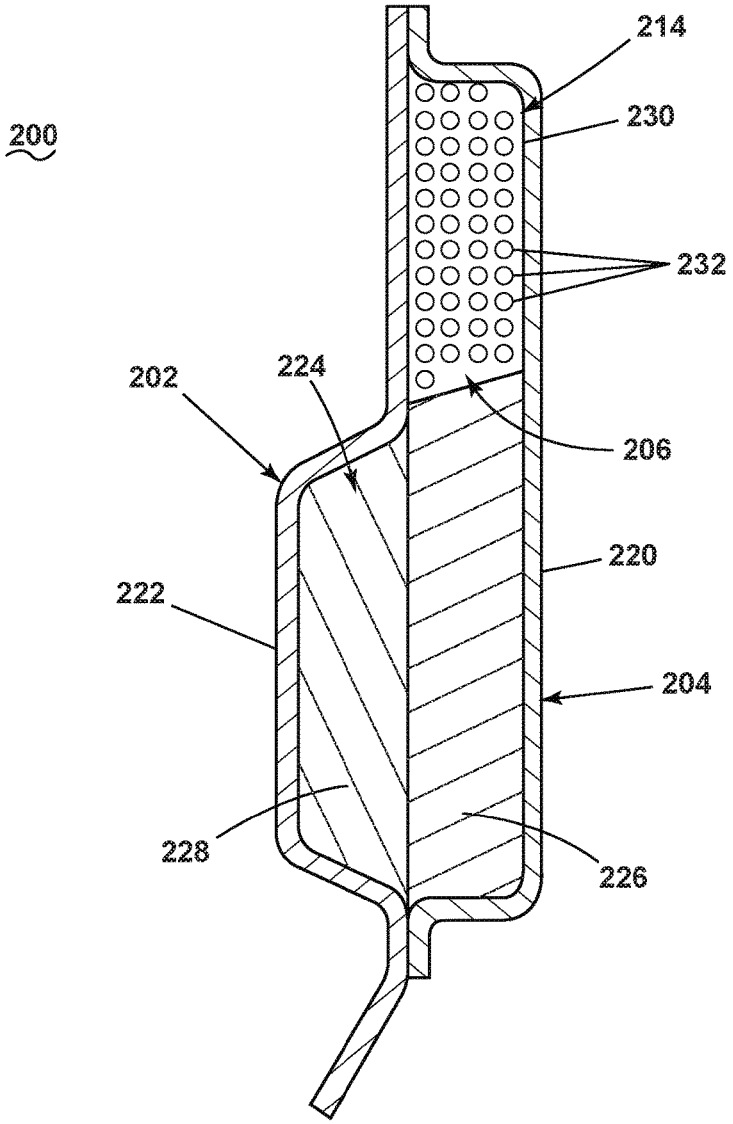
FIG. 10 is sectional view taken across section X-X of FIG. 9, illustrating perforations in baffles as the noise attenuation structures.

Referring now to FIG. 10, showing the toe kick panel 200 taken along section X-X of FIG. 9, the frame 202 includes a front panel 220 and a rear panel 222. The front panel 220 couples to the rear panel 222 to define an interior 224 of the toe kick panel 200. The insulator 204 is provided in the interior 224, separated into a front portion 226 and a rear portion 228 complementary to the shape of the front and rear panels 220, 222. The front portion 226 and rear portion 228 can be a single, integral component, and need not be separated.

Alternatively, the front panel 220 and the front insulator 226 can be a single integral element. As a multi-layer material 140, similar to that of FIG. 6, the front panel 220 can be a compressed portion and the front portion 226 can be a non-compressed portion, as a single, integral unit. Similarly, the rear panel 222 can be a compressed portion and the rear portion 228 can be a non-compressed portion. The combination of the two units can define the exhaust conduit 206 and insulator 204. The non-compressed portions further attenuate noise with improved sound absorption along the exhaust conduit 206. The compressed portions as the front and rear panels 220, 222 attenuate any excess noise emanating from the non-compressed portions.

The noise attenuation structure 214 can be physical structure, such as a baffle 230, for example, extending across the entire cross-sectional area of the exhaust conduit 206. Alternatively, the noise attenuation structure 214 can be a panel having air passages or perforations. For example, the panel can be a multi-layer acoustic absorptive material, such as the multi-layer material as described herein, including a plurality of round perforations. In another example, the noise attenuation structure can be any porous material, wherein the air passages are defined by the pores of the porous material. While shown as extending across the entire exhaust conduit 206, it should be appreciated that the baffle 230 can extend only partially across the exhaust conduit 206. For example, the baffles 230 can be organized within the exhaust conduit 206 in an alternative pattern, extending only partially across the exhaust conduit 206, to define a serpentine path through the exhaust conduit 206. A serpentine path for the exhaust conduit 206 can further attenuate sound passing through the toe kick panel 200. The baffle 230 can include a plurality of air passages, shown as perforations 232, permitting a flow of air to pass through the baffles 230. The perforations 232 permit the flow of air to pass along the exhaust conduit 206, while providing the noise attenuation at the noise attenuation structure 214. While the perforations 232 are shown as large openings, it should be appreciated that the perforations 232 can be much smaller. For example, the baffle 230 can be made of a porous material, with the perforations 232 represented as a porosity of the baffle 230, permitting the flow of air to pass through the baffles 230 at a much slower rate as compared to the larger perforations 232, while providing improved noise attenuation at the baffles 230. Thus it should be appreciated that the concentration and size of the perforations 232 can be particularly adapted based upon the expected air flow rate through the exhaust conduit 206 and the noise attenuation needs along the exhaust conduit 206.

Figure 11:
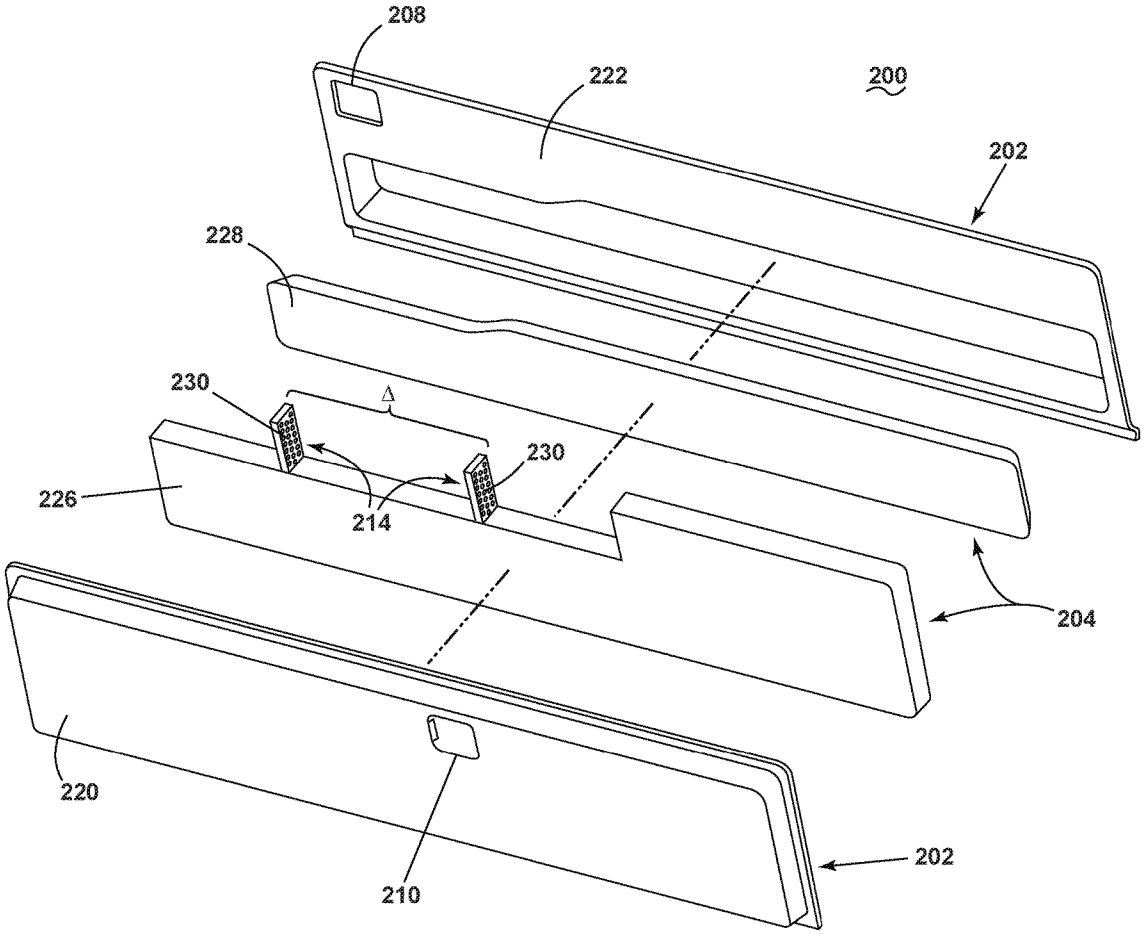
FIG. 11 is an exploded view of the toe kick panel of FIG. 9.

Referring now to FIG. 11, the front and rear panels 220, 222 have been exploded illustrating front and rear insulators 226, 228. The baffles 230 mount to the front insulator 226, being spaced from one another by a distance Δ. While two baffles 230 are shown at the particular distance Δ, it should be understood that FIG. 11 is only exemplary. Any number of noise attenuation structures 214 can be used at any distance Δ within the size of the appliance. Further, it should be understood the baffles 230 can mount to any structure adjacent the exhaust conduit 206, such as to the frame 202. The toe kick panel 200 can include any number of baffles 230 spaced at any distance Δ. The number of baffles 230 and the distance Δ between the baffles 230 can be adapted based upon the particular noise attenuation needs of the particular appliance. As such, the distance Δ would be equal among multiple baffles 230 throughout the exhaust conduit 206, except for any anticipated dampening of the noise along the airflow path based upon the total number of baffles 230. For example, the multi-layer material of the condenser, as described herein, can attenuate sound at a first anticipated frequency or loudness. The toe kick panel 200 can attenuate the sound exiting the condenser having another frequency and loudness, based upon the resultant attenuation within the condenser upstream of the toe kick panel 200.

In one non-limiting example, the appliance can have a noise spectrum having a predetermined frequency of noise passed to the toe kick panel 200. The predetermined frequency can be determined based upon noise generated in the tub or treating chamber, or passing through the condenser.

Such a predetermined frequency can be determined based upon the particular appliance, or model thereof. The predetermined frequency can also be representative of a maximum or minimum frequency. Based upon the predetermined frequency of the particular appliance, the wavelength can be determined in air. Based upon the predetermined frequency and predetermined wavelength thereof, the baffles 230 can be spaced at the distance Δ defined as a quarter (25%) of the wavelength to attenuate the noise. At the distance Δ defined as the quarter wavelength, the baffles 230 effectively attenuate the noise of the exhausted, condensed air passing through the toe kick panel 200 and exhausting to the ambient. In addition to the spacing of the noise attenuation structures 214 or baffles 230, the toe kick panel 200 can be made of the multi-layer material, such as that of FIGS. 5 and 6, to further attenuate any sound contacting the toe kick panel 200 within the exhaust conduit 206 in the areas between adjacent noise attenuation structures 214. Furthermore, the bottom panel 20 (FIG. 1) can be made of the multi-layer material, or other noise attenuation material as described herein, to attenuate any noise leaking from the toe kick panel 200. Additional insulation material can be provided between the bottom panel 20 and the toe kick panel 200, however, the noise attenuation can be significant enough that such insulation is not required or that the required insulation is reduced.

Such spacing of the noise attenuation structures, as well as the particular implementation thereof, including location, size, number, thickness, porosity, spacing, material, the air passages including number or size thereof, the frame, the multi-layer material, or the condenser, in non-limiting examples, can be tuned or particularly tailored based upon the anticipated frequency and loudness of the sound entering the toe kick panel 200.

The toe kick panel 200 as described effectively attenuates noise or sound while permitting exhausting of condensed air from a condenser to the exterior of the appliance at the front. Spacing the noise attenuation structures at the quarter-wavelength can provide for improved noise reduction based upon a predetermined frequency of the particular appliance or model. Such a frequency, for example, can be a minimum or maximum frequency expected. The reduced noise provides for quieter operation with less frequency content for a preferable consumer experience. Additionally, less noise insulation is required reducing costs. Finally, condensed air is exhausted to the ambient as opposed to in a confined area adjacent the appliance, where waterproofing would otherwise be required, further reducing costs.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A dish treating appliance for treating dishes according to an automatic cycle of operation, the dish treating appliance comprising:

a chassis;

a tub provided within the chassis at least partially defining a treating chamber and having an access opening to the treating chamber;

a cover selectively opening and closing the access opening;

a condenser provided between the chassis and the tub having an inlet and an outlet, with the inlet fluidly coupled to the tub and feeding air from the tub to the condenser, whereby the condenser is configured condense moist air from the treating chamber;

a toe kick panel having an interior defining an exhaust conduit provided on the chassis at a front of the dish treating appliance at a base, fluidly coupled to the outlet of the condenser, the toe kick panel preventing a user from kicking the exhaust conduit; and at least one noise attenuation structure disposed in the exhaust conduit.

2. The dish treating appliance of claim 1 wherein the at least one noise attenuation structure is spaced along the exhaust conduit based upon a wavelength of a predetermined frequency of noise generated by the condenser.

3. The dish treating appliance of claim 2 wherein the predetermined frequency is a minimum frequency or a maximum frequency of noise generated by the condenser.

4. The dish treating appliance of claim 2 wherein the at least one noise attenuation structure is spaced in the exhaust conduit based upon a quarter of the wavelength of the predetermined frequency of noise generated by the condenser.

5. The dish treating appliance of claim 1 wherein the at least one noise attenuation structure is at least one physical structure with air passages.

6. The dish treating appliance of claim 5 wherein the at least one noise attenuation structure is at least one baffle.

7. The dish treating appliance of claim 5 wherein the at least one baffle comprises a panel with perforations.

8. The dish treating appliance of claim 5 wherein the physical structure is a porous material and the air passages are pores of the porous material.

9. The dish treating appliance of claim 1 wherein the toe kick panel further is made of an acoustic absorptive material.

10. The dish treating appliance of claim 9 wherein the absorptive acoustic material is a multi-layer material.

11. The dish treating appliance of claim 10 wherein the condenser includes the multi-layer material to attenuate sound passing through the condenser upstream of the toe kick panel.

12. The dish treating appliance of claim 1 wherein the toe kick panel comprises a frame that includes a front panel and rear panel.

13. The dish treating appliance of claim 12 wherein the front panel and the rear panel define the interior of the toe kick panel.

14. The dish treating appliance of claim 12 further comprising an insulator located in the interior of the toe kick panel.

15. The dish treating appliance of claim 14 wherein the exhaust conduit extends parallel to the insulation and a portion of the conduit is defined by the insulation.

16. The dish treating appliance of 14 wherein the insulator comprises front portion and a rear portion.

17. The dish treating appliance of claim 16 wherein the front panel and the front portion are a multi-layered material forming integral element.

18. The dish treating appliance of claim 17 wherein the front panel of the multi-layered material is compressed and the front portion of the multi-layered material is non-compressed.

19. The dish treating appliance of claim 16 wherein the rear panel and the rear portion are a multi-layered material forming integral element.

20. The dish treating appliance of claim 19 wherein the rear panel of the multi-layered material is compressed and the rear portion of the multi-layered material is non-compressed.

* * * * *